US008459475B2

(12) United States Patent
Higueroa et al.

(10) Patent No.: US 8,459,475 B2
(45) Date of Patent: Jun. 11, 2013

(54) CONVERTIBLE STORAGE RACK SYSTEM

(76) Inventors: Bernard A. Higueroa, Chino Hills, CA (US); Michael Dressendorfer, San Dimas, CA (US); Sasha Johnson, Brea, CA (US); Bouasry Ott, Anaheim, CA (US)

( * ) Notice: Subject to any disclaimer, the term of this patent is extended or adjusted under 35 U.S.C. 154(b) by 865 days.

(21) Appl. No.: 12/567,499

(22) Filed: Sep. 25, 2009

(65) Prior Publication Data

US 2010/0078399 A1 Apr. 1, 2010

Related U.S. Application Data

(60) Provisional application No. 61/100,484, filed on Sep. 26, 2008.

(51) Int. Cl.
*A47F 5/00* (2006.01)

(52) U.S. Cl.
USPC ..... 211/162; 211/71.01

(58) Field of Classification Search
USPC ..... 211/71.01, 189, 113, 118, 119, 162, 211/194, 191; 312/334.23, 334.24, 334.25, 312/317.1
See application file for complete search history.

(56) References Cited

U.S. PATENT DOCUMENTS

| | | | | |
|---|---|---|---|---|
| 447,658 | A * | 3/1891 | Brockmann | 211/162 |
| 941,483 | A * | 11/1909 | Williams | 312/308 |
| 1,065,530 | A * | 6/1913 | Judelson | 312/296 |
| 1,427,142 | A * | 8/1922 | Wolff et al. | 211/4 |
| 1,513,596 | A * | 10/1924 | Judelson | 211/94.03 |
| 1,853,061 | A * | 4/1932 | Judelson | 34/664 |
| 2,921,688 | A * | 1/1960 | Riemenschneider | 108/16 |
| 2,923,584 | A * | 2/1960 | Broderick, Jr. | 312/317.1 |
| 3,874,756 | A * | 4/1975 | Greene | 312/234 |
| 4,008,807 | A * | 2/1977 | Phillips | 211/34 |
| 4,657,317 | A | 4/1987 | Gemma | |
| 4,666,201 | A * | 5/1987 | Chap | 294/161 |
| 4,715,669 | A | 12/1987 | Baillie et al. | |
| 5,076,442 | A * | 12/1991 | Hakeem | 211/34 |
| 5,127,721 | A * | 7/1992 | Inden | 312/249.9 |
| 5,154,305 | A * | 10/1992 | Whitney | 211/162 |
| 5,468,063 | A * | 11/1995 | Simonek | 312/334.28 |
| 5,897,005 | A * | 4/1999 | Bernens et al. | 211/189 |
| 5,944,400 | A * | 8/1999 | Fulterer | 312/334.25 |
| 6,036,286 | A * | 3/2000 | Krumholz | 312/198 |
| 6,199,966 | B1 * | 3/2001 | Fulterer | 312/334.24 |
| 6,231,138 | B1 * | 5/2001 | Janson | 312/201 |
| 6,604,640 | B1 * | 8/2003 | Jehin | 211/191 |

(Continued)

FOREIGN PATENT DOCUMENTS

GB 2201339 A * 9/1988

*Primary Examiner* — Darnell Jayne
*Assistant Examiner* — Stanton L Krycinski
(74) *Attorney, Agent, or Firm* — Kenneth L. Green

(57) ABSTRACT

A convertible media and document storage system uses elements of common pallet rack framing and is convertible between open slot and container storage. The container storage includes pilasters hanging from horizontal beam elements of the framing, and vertically spaced apart pairs of adjustable wireform racks engage the pilasters and provide horizontal ledges for supporting containers of various sizes. The use of hanging pilasters minimizes strength and material requirements. The open slot storage includes tall vertical drawers riding on overhead rails attachable to the same horizontal beam elements and individually horizontally drawn for access to the stored material such as data tape and disk media. The storage system optimizes utilization of space and allows large facilities to reconfigure storage between open slot and container storage when demands change.

15 Claims, 7 Drawing Sheets

U.S. PATENT DOCUMENTS

| | | | | |
|---|---|---|---|---|
| 6,796,248 | B1 | 9/2004 | Dressendorfer et al. | |
| 7,475,955 | B2 * | 1/2009 | Dressendorfer et al. | 312/334.26 |
| 2002/0140328 | A1 * | 10/2002 | Dressendorfer et al. | 312/334.23 |
| 2002/0144634 | A1 * | 10/2002 | Dressendorfer et al. | 108/107 |
| 2007/0246434 | A1 * | 10/2007 | Adams et al. | 211/8 |
| 2009/0101611 | A1 * | 4/2009 | Lin et al. | 211/113 |

* cited by examiner

CONVERTIBLE STORAGE RACK SYSTEM

The present application claims the priority of U.S. Provisional Patent Application Ser. No. 61/100,484 filed Sep. 26, 2008, which application is incorporated in its entirety herein by reference.

BACKGROUND OF THE INVENTION

The present invention relates to document and media storage and in particular large scale storage requiring periodic reallocation of storage capabilities.

Both open slot storage and container storage are commonly utilized to store documents and media at offsite vaults. Open slot storage generally comprises vertical drawers individually horizontally drawn from a common cabinet and is commonly used for storing media such as data tapes and disks. The vertical drawers are configurable to allow creation of vertically spaced apart shelves holding rows of common sized media (e.g. tape or disk) containers and the media is accessible by horizontally drawing the drawer containing the media from the cabinet. U.S. Pat. No. 4,657,317 discloses a very efficient open slot storage unit manufactured by Russ Bassett, Corp. in Whittier, Calif. under the trademark Gemtrac™. The '317 patent is herein incorporated by reference in its entirety.

Container storage includes vertically spaced apart horizontal shelves for containers. The containers hold multiple media, for example, tapes, typically 20-40 per container. Known container storage is constructed using common pallet racks as a frame. Unfortunately, the cabinets of open slot storage are very different from the pallet racking used to support container storage and share no common structure. For example, the vertically spaced apart horizontal shelves required for known container storage are not compatible with the full height vertical drawers of the open slot storage systems. Both storage systems require major installation expenditure decisions made years in advance as to the mix of open slot or case storage which will be needed in the future. When storage needs change, costs of converting from one to another are prohibitive, resulting in inefficient use of storage space.

A need thus exists for storage allowing convenient conversion between open slot and container storage.

BRIEF SUMMARY OF THE INVENTION

The present invention addresses the above and other needs by providing a convertible media and document storage system which uses elements of common pallet rack framing and is convertible between open slot and container storage. The container storage includes pilasters hanging from existing horizontal beam elements of the framing, and vertically spaced apart pairs of adjustable wireform racks engage the pilasters and provide horizontal ledges for supporting containers of various sizes. The use of hanging pilasters minimizes strength and material requirements. The open slot storage includes tall vertical drawers riding on overhead rails attachable to the same horizontal beam elements and individually horizontally drawn for access to the stored material such as data tape and disk media. The storage system optimizes utilization of space and allows large facilities to reconfigure storage between open slot and container storage when demands change.

In accordance with one aspect of the invention, there is provided a reconfigurable hanging storage system. The hanging storage system includes framing having upper horizontal beams and laterally spaced apart pairs of pilasters hanging from the upper horizontal beams. The pilasters are adjustable laterally for positioning on the upper horizontal beams and for different width containers. Pairs of racks are attached to the pilasters for carrying containers and the racks are independently adjustable vertically for different height containers. Using hanging pilasters reduces both material requirements, because the pilasters are in tension versus compression, and less space consumed by the pilasters, because less material is required. Using the hanging pilasters further overcomes a need for fixed shelves which would interfere with conversion to open slot storage.

In accordance with another aspect of the invention, there is provided a configurable storage system. The configurable storage system includes a multiplicity of rectangular frames residing in parallel facing pairs, open slot storage units attached to the frames, and container storage attached to the frames. Each pair of the frames is separated by an aisle providing spacing S between the pairs frames of approximately one frame depth D. Each frame includes uprights, horizontal beams, and end bracing. The uprights comprise four horizontally spaced apart vertical uprights, one of the uprights at each corner of the frame, the uprights forming a rectangular horizontal footprint having the width W and the depth D. The beams comprise lower and upper horizontal beams. The lower horizontal beams are attached to the uprights along the width dimension at the same height. The upper horizontal beams are vertically spaced apart above each of the at least one pairs of lower horizontal beams and are attached to the uprights along the length dimension at the same height. The pair of lower horizontal beams and the pair of upper horizontal beams separated vertically by a section height Hs. The end bracing connects the uprights along the depth dimension and the length L, the width W, and the height Hs define a section of the storage system. The open slot storage units each include a horizontal overhead rail, a bottom drawer guide, and drawers. The horizontal overhead rails are configured for clamping attachment to one of the pairs of upper horizontal beams and reaching across the pair of upper horizontal beams and across the aisle to an adjacent pair of upper horizontal beams. The bottom drawer guide configured for clamping attachment to one of the pair of lower horizontal beams and reaching across the pair of lower horizontal beams. The drawers are slidably carried by the overhead rails and guided by the bottom drawer guides and are slidable into the aisle for providing access to stored material. The container storage includes laterally spaced apart pairs of pilasters adjustably configured for clamping attachment to one of the pairs of horizontal beams and having a multiplicity of vertically spaced apart holes, and pairs of opposing wireform racks configured for attachment to the pilasters using the multiplicity of vertically spaced apart holes and having opposing ledges for receiving containers. The pilaster separation is adjustable for different width containers.

In accordance with another aspect of the invention, there is provided a configurable hanging storage system. The configurable hanging storage system includes at least two rectangular frames and container storage. Each frame has a width dimension with width W and a depth dimension with depth D. Pairs of the frames reside in parallel with faces along the width dimension facing each other and separated by an aisle providing spacing S between the frames. Each frame includes uprights, horizontal beams, and end bracing. The uprights comprise four horizontally spaced apart vertical uprights, one of the uprights at each corner of the frame, the uprights forming a rectangular horizontal footprint having the width W and the depth D. The beams comprise lower and upper horizontal beams. The lower horizontal beams are attached to the uprights along the width dimension at the same height. The upper horizontal beams are vertically spaced apart above each of the at least one pairs of lower horizontal beams and are attached to the uprights along the length dimension at the same height. The pair of lower horizontal beams and the pair of upper horizontal beams are separated vertically by a section height Hs. The end bracing connects the uprights along the depth dimension and the length L, the width W, and the height Hs define a section of the storage system. The container storage resides in one of the sections of the storage system and comprises pairs of laterally (i.e, along the width dimension of the frame) pilasters hanging from the upper horizontal beams and pairs of opposing racks attached to the pilasters and providing ledges receiving containers. Pilaster top bars and top clamping fingers are attached at each end of the top bars for tightly sandwiching a horizontal bottom edge of the upper horizontal beams between the top bars and top clamping fingers to attach the pilasters to the upper horizontal beams. Pilaster bottom bars reaching the length of the bottoms of the pilasters and bottom clamping fingers are attached to bottom surfaces at each end of the bottom bars. A top horizontal edge of the lower horizontal beams is sandwiched between the bottom clamping fingers and the bottom bar to attach the pilasters to the bottom horizontal beams.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
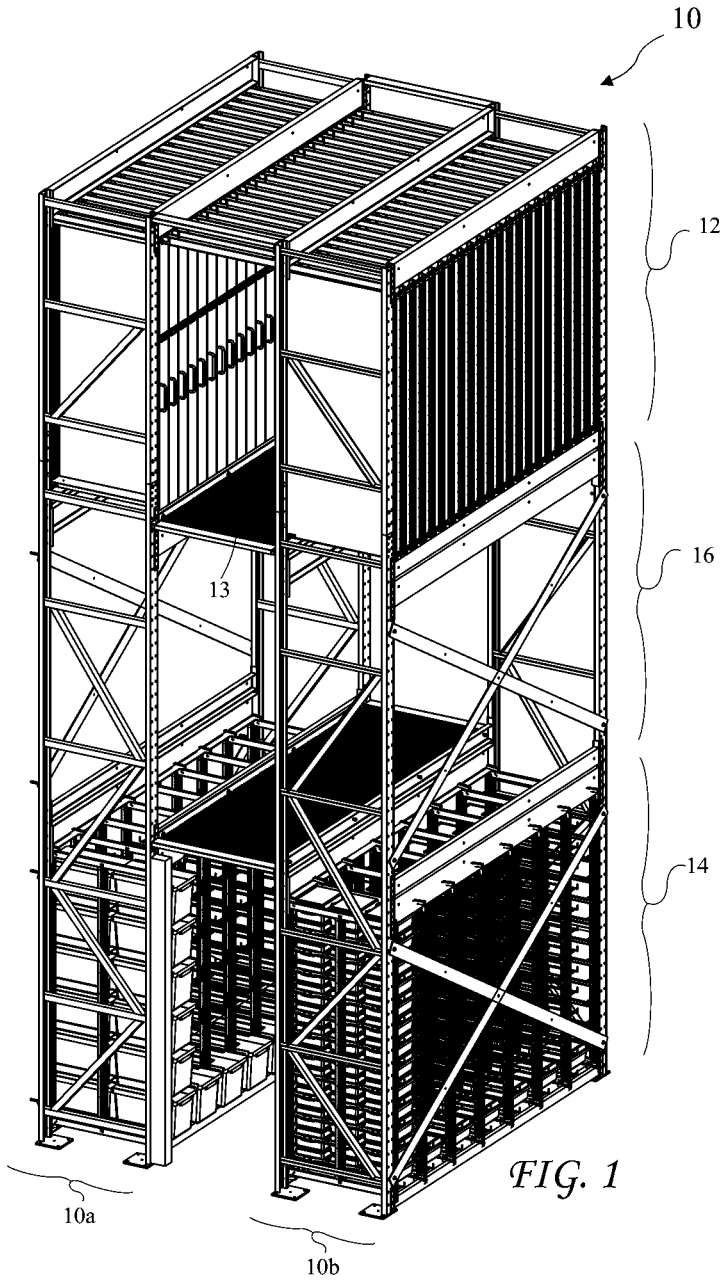
FIG. 1 is a perspective view of a multi-level convertible media and document storage system according to the present invention.

A perspective view of a convertible media and document storage system 10 according to the present invention is shown in FIG. 1. The convertible media and document storage system 10 includes side by side cooperating halves 10*a* and 10*b*. The halves 10*a* and 10*b* each include a top open slot storage section 12, a center empty section 16, and a bottom container storage section 14. The container storage bottom section 14 of the first half 10*a* is configured to carry small containers 32*a* (see FIG. 5A) and the container storage bottom section 14 of the second half 10*b* is configured to carry tub containers 32*c* (see FIG. 5C). All of the sections of the convertible media and document storage system 10 according to the present invention may be reconfigured into open slot storage sections, container storage sections, or empty sections as needs change. A walkway 13 is provided for access to the open slot storage section 12.

Figure 2C:
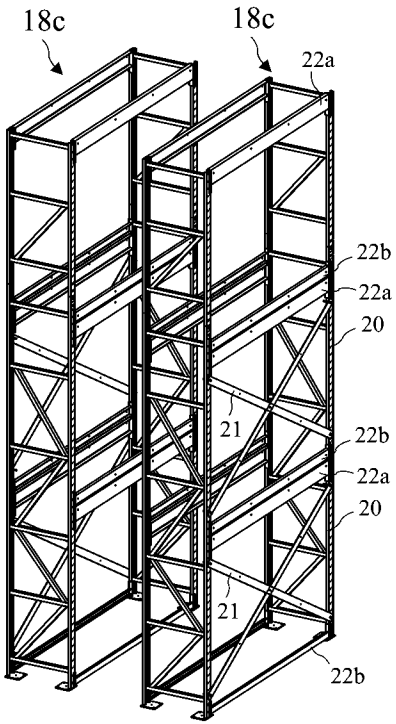
FIG. 2C is a perspective view of a pair of three level side by side frames positioned to provide support for the convertible media and document storage system according to the present invention.
Figure 2B:
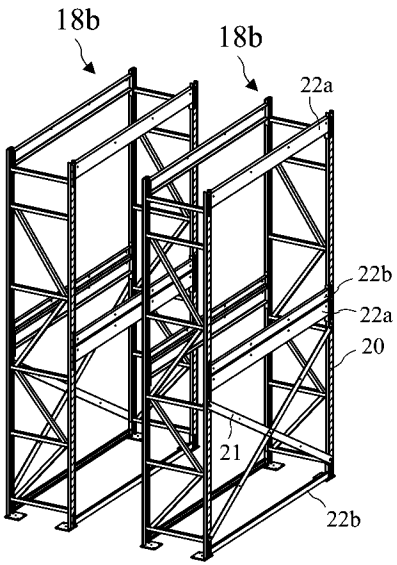
FIG. 2B is a perspective view of a pair of two level side by side frames positioned to provide support for the convertible media and document storage system according to the present invention.
Figure 2A:
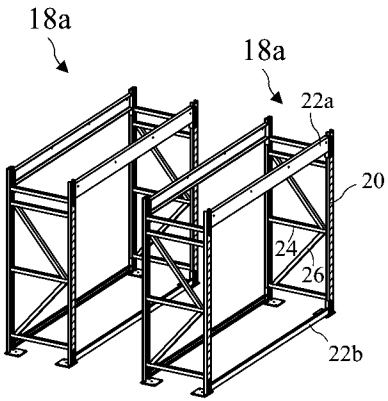
FIG. 2A is a perspective view of a pair of single level side by side frames positioned to provide support for the convertible media and document storage system according to the present invention.

A perspective view of a pair of side by side single level pallet rack frames 18*a* positioned to provide support for the convertible media and document storage system 10 according to the present invention is shown in FIG. 2A, a perspective view of a pair of side by side two level pallet rack frames 18*b* positioned to provide support for the convertible media and document storage system 10 according to the present invention is shown in FIG. 2B, and a perspective view of a pair of side by side three level pallet rack frames 18*c* positioned to provide support for the convertible media and document storage system 10 according to the present invention is shown in FIG. 2C. The pallet rack frames 18*a*, 18*b*, and 18*c* include upper horizontal beams 22*a* and lower horizontal beams 22*b* attached to vertical uprights 20, and end bracing comprising horizontal end braces 24 and diagonal end braces 24. Additionally, "X" bracing 21 is provided on rear faces of the bottom level in the two level frames 18*a* and on the bottom and middle level of the three level frames 18*c*. The pallet rack frames 18*a*, 18*b*, and 18*c* may comprise common pallet rack frames which are easily obtained. The "X" bracing is required in many cases because the frames have fewer horizontal beams to provide stability than typical pallet frames.

The upper horizontal beams 22*a* carry a large load and are preferably approximately eight inch high beams. The lower most lower horizontal beam 22*b* is preferably approximately three inches high and carries the least load of all the horizontal beams. The remaining lower horizontal beams 22*b* are preferably approximately five inches high and carry a moderate load due to supporting the walkway 13.

Figure 3:
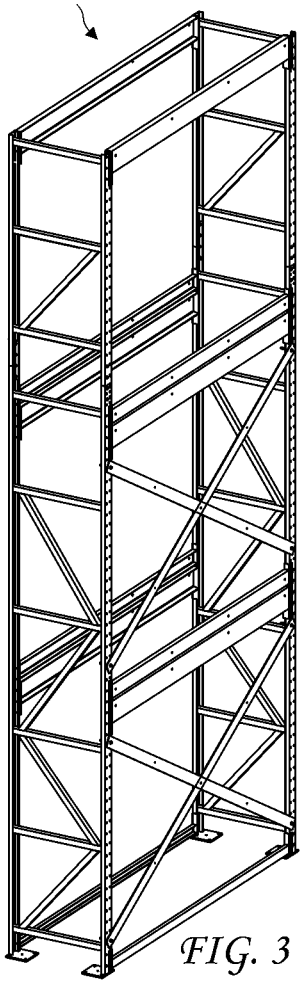
FIG. 3 is a perspective view of a single three level frame suitable for supporting the convertible media and document storage system according to the present invention.
Figure 3A:
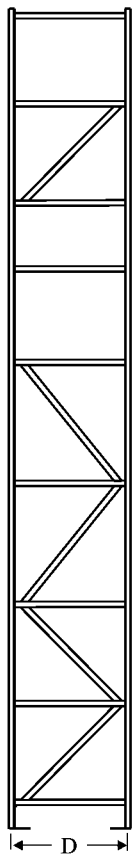
FIG. 3A is a side view of one of the three level frames suitable for supporting the convertible media and document storage system according to the present invention.
Figure 3B:
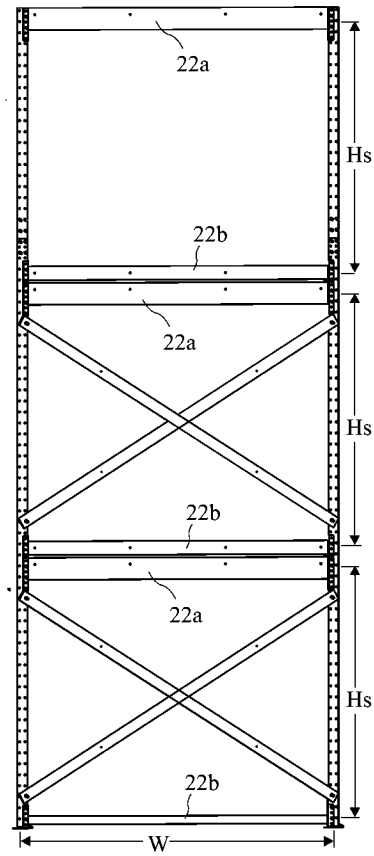
FIG. 3B is an end view of one of the three level frames suitable for supporting the convertible media and document storage system according to the present invention.
Figure 3C:
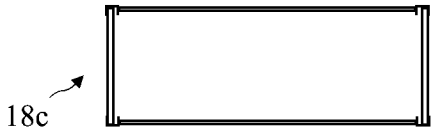
FIG. 3C is a top view of one of the three level frames suitable for supporting the convertible media and document storage system according to the present invention.

A perspective view of one of the frames 18*c* is shown in FIG. 3, a side view of one of the frames 18*c* is shown in FIG. 3A, a rear view of one of the frames 18*c* is shown in FIG. 3B, and a top view of one of the frames 18*c* is shown in FIG. 3C. Rails 40 (see FIG. 9A) for open slot storage units 30 and pilasters 38 (see FIG. 6) for container storage are hung from the upper horizontal beams 22*a*. The lower horizontal beams 22*b* provide support for the walkways 13, for bottom guides 56 for open slot storage 30 or bottom attachment of the container storage 38.

The frames 18*c* further have a width W and a depth D, and each section has a section height Hs. The lateral dimension in the following description is aligned with the width W, and the longitudinal dimension with the depth D as viewed by a user accessing the stored material. The depth D is preferably approximately 38 inches and the width W is preferably approximately ten feet. The preferred depth D facilitates using elements of existing vertical drawer systems which are a large component of the cost of constructing a convertible media and document storage system. For example, the Gemtrac™ vertical drawer system manufactured by Russ Bassett, Corp. in Whittier, Calif. and described in U.S. Pat. No. 4,657,317 incorporated by reference above.

Figure 4B:
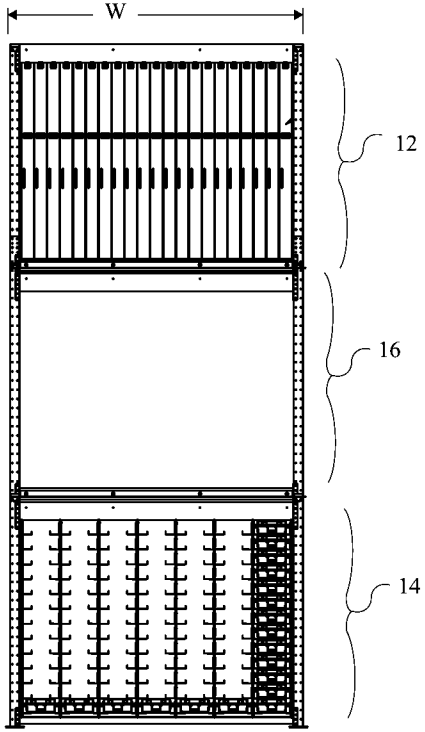
FIG. 4B is a front view of a second half of the document storage system according to the present invention including a top open slot storage section, a center empty section, and a bottom container storage section configured for storing small containers.
Figure 4A:
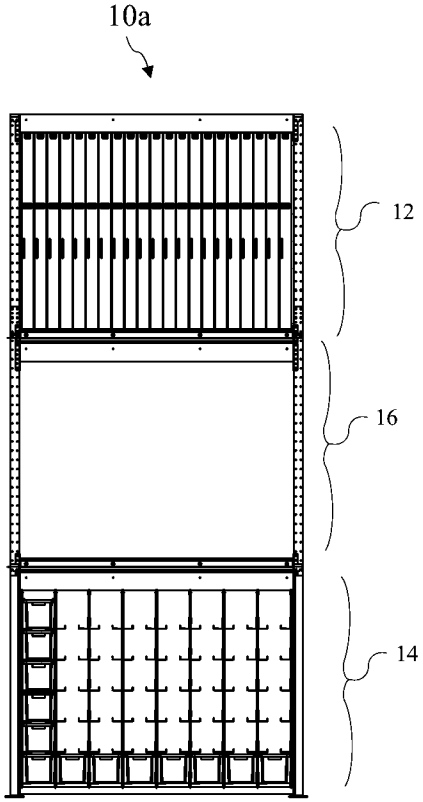
FIG. 4A is a front view of a first half of the document storage system according to the present invention including a top open slot storage section, an empty center section, and a bottom container storage section configured for storing tubs.

A front view (i.e., as viewed from the center aisle) of the first half 10*a* of the document storage system 10 according to the present invention, including the top open slot storage section 12, the center empty section 16, and the bottom container storage section 14 configured for tub containers 32*c* is shown in FIG. 4A and a side view of a second half 10*b* of the document storage system according to the present invention including the top open slot storage section 12, the center empty section 16, and the bottom container storage section 14 configured for small storage containers 32*a* is shown in FIG. 4B.

Figure 5A:
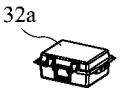
FIG. 5A shows the small storage container according to the present invention.
Figure 5B:
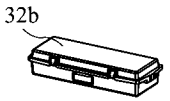
FIG. 5B shows a large storage container according to the present invention.
Figure 5C:
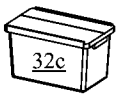
FIG. 5C shows the tub according to the present invention.

The small storage container 32*a* according to the present invention is shown in FIG. 5A, the large storage container 32*b* according to the present invention is shown in FIG. 5B, and the tub container 32*c* according to the present invention is shown in FIG. 5C. The container storage sections 14 of the document storage system 10 according to the present invention are easily convertible to store any of the containers 32*a*, 32*b*, and 32*c*. As described below, the container storage sections 14 may also be configured for other containers. The document storage system 10 may be configured with open slot storage sections 12 in any position, but preferably are opposite another open slot storage section 12. Further, each section may be reconfigured from open slot storage to container storage and from container storage to open slot storage.

Figure 7A:
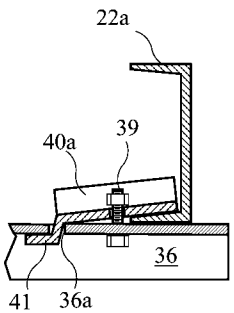
FIG. 7A shows a cross-sectional view of the clamping apparatus according to the present invention.
Figure 7:
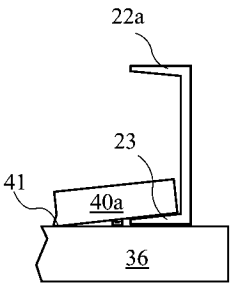
FIG. 7 shows details of top clamping apparatus according to the present invention.
Figure 6A:
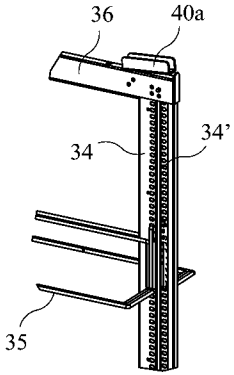
FIG. 6A shows detail 6A of FIG. 6.
Figure 6:
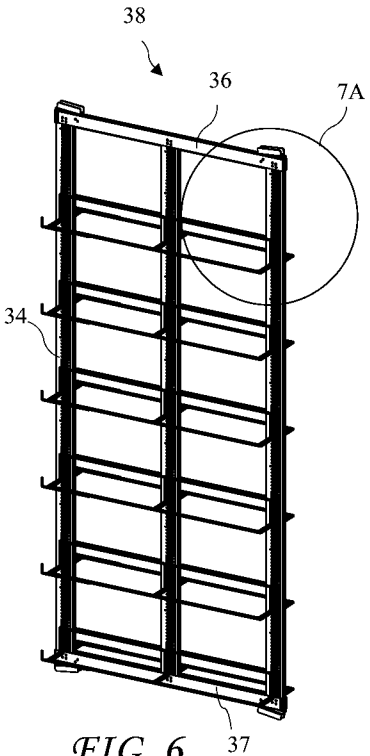
FIG. 6 shows a pilaster configured for clamping to a pair of upper horizontal beams, and racks attached to the pilaster, according to the present invention.

A pilaster 38 of a container storage section is shown in FIG. 6, details of the pilaster 38 are shown in FIG. 6A, a clamping system according to the present invention for attaching the pilaster 38 to the upper horizontal beam 22*a* are shown in FIG. 7, a cross-sectional view of the clamping system is shown in FIG. 7A. The pilasters 38 include top bars 36 which clamp onto the bottom horizontal edges 23 of the upper horizontal beams 22*a* allowing infinite adjustment of the lateral separation of pilasters 38 to accommodate containers of various widths.

The clamping attachment is preferably performed by top clamping fingers 40*a*. The fingers 40*a* have a bent tab 41 which pass through a slot 36*a* in the top bar 36 of the pilaster 38. A tightening stud 39 is used to tightly sandwich the bottom horizontal edge 23 of the upper horizontal beam 22*a* between the top bar 36 and the finger 40*a*.

Figure 7B:
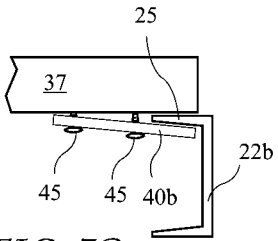
FIG. 7B shows details of bottom clamping apparatus according to the present invention.

Details of a preferred bottom clamping apparatus according to the present invention are shown in FIG. 7B. A bottom clamping finger (or bar) 40*b* is attached to the bottom bar 37 of the pilaster 38 by two screws 45. The top horizontal edge 25 of the lower horizontal beam 22*b* is sandwiched between the finger 40*b* and the bottom bar 37 to secure the pilaster 38 to the frame.

The storage system according to the present invention includes the clamping attachments described in FIGS. 7, 7A, and 7B to provide for simple conversion between container storage and open slot storage, and the pilasters and the open slot storage units are preferably attached only using the clamping attachments and require no additional attaching structure.

Figure 8:
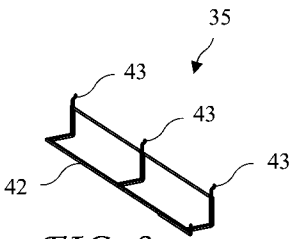
FIG. 8 shows the rack according to the present invention.

The racks 35 used with the pilasters 38 are shown in FIG. 8. The pilasters 38 includes vertical members 34 having vertically spaced apart holes 34'. The ranks 35 includes bent elements 41 which are insertable into the hold 34' to attach the racks 35 to the pilasters 38. The racks 35 further include opposing ledges 42 for carrying the containers 23*a*, 32*b*, and 32*c* (see FIGS. 5A, 5B, and 5C). The multiplicity of holes 34' allow adjustment of the racks 35 for different height containers.

Figure 9B:
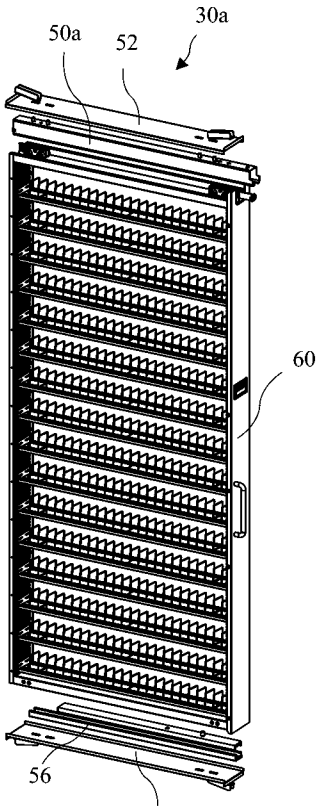
FIG. 9B shows a single vertical drawer used with the open slot storage section according to the present invention.
Figure 9A:
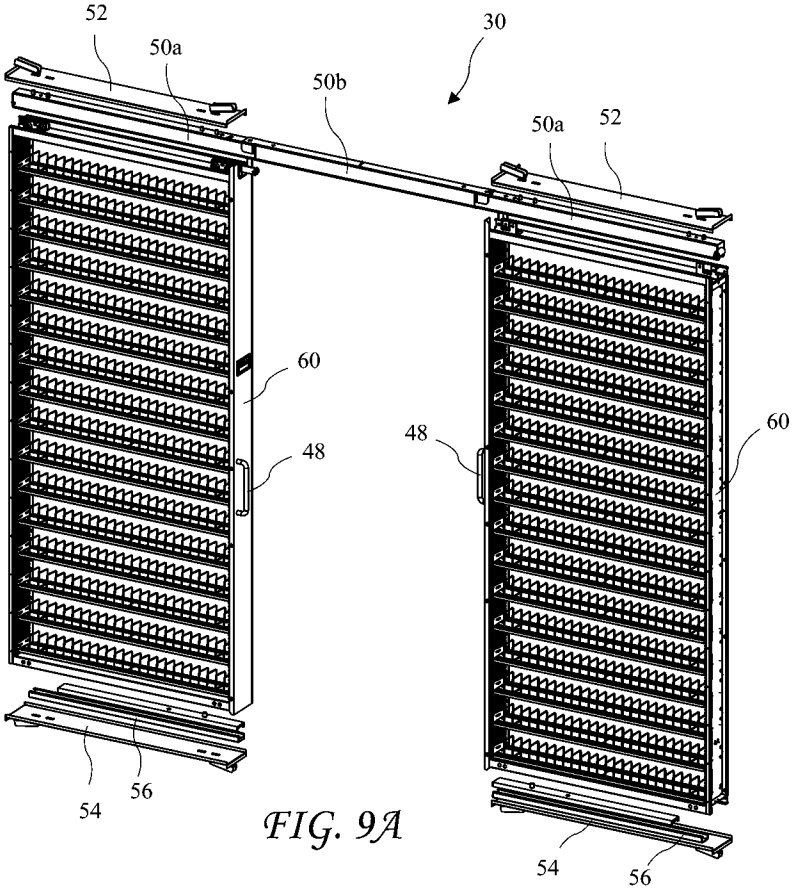
FIG. 9A shows an opposing pair of vertical drawers used with the open slot storage section according to the present invention.

A pair of vertical drawer elements 60 for use with slot storage sections according to the present invention are shown in FIG. 9A and a single vertical drawer element 60 according to the present invention is shown in FIG. 9B. Details of a vertical drawer element are disclosed in U.S. Pat. No. 4,657,317 incorporated by reference above. Pairs of the slot storage sections generally face each other, and handle 48 are preferably alternated on opposing drawers to allow maximum opening. The drawers include rollers carried in horizontal overhead rails 50*a* and 50*b* connecting opposing slot storage sections for both carrying the drawers and providing support to the document storage system 10. The rails 50*a* are attached to second top bars 52 which are preferably clamped to the upper horizontal members 22*a* as shown in FIGS. 7A and 7B. The vertical drawer elements 60 further include bottom guides 56 attached to second bottom bars 54. The bottom bars 54 are preferably clamped to the top horizontal edges of the lower horizontal beams 22*b* in the same manner as shown in FIG. 7B for the pilaster 38. The rails and top bars may be a single piece and the guides and bottom bars may also be a single piece. Because the rails 50*a* and 50*b* attach to the second top bars 52 in the same manner as the top bars 36 (see FIG. 7), the vertical draw storage and the container storage are interchangeable, and may reside side by side in a single container storage.

Figure 10:
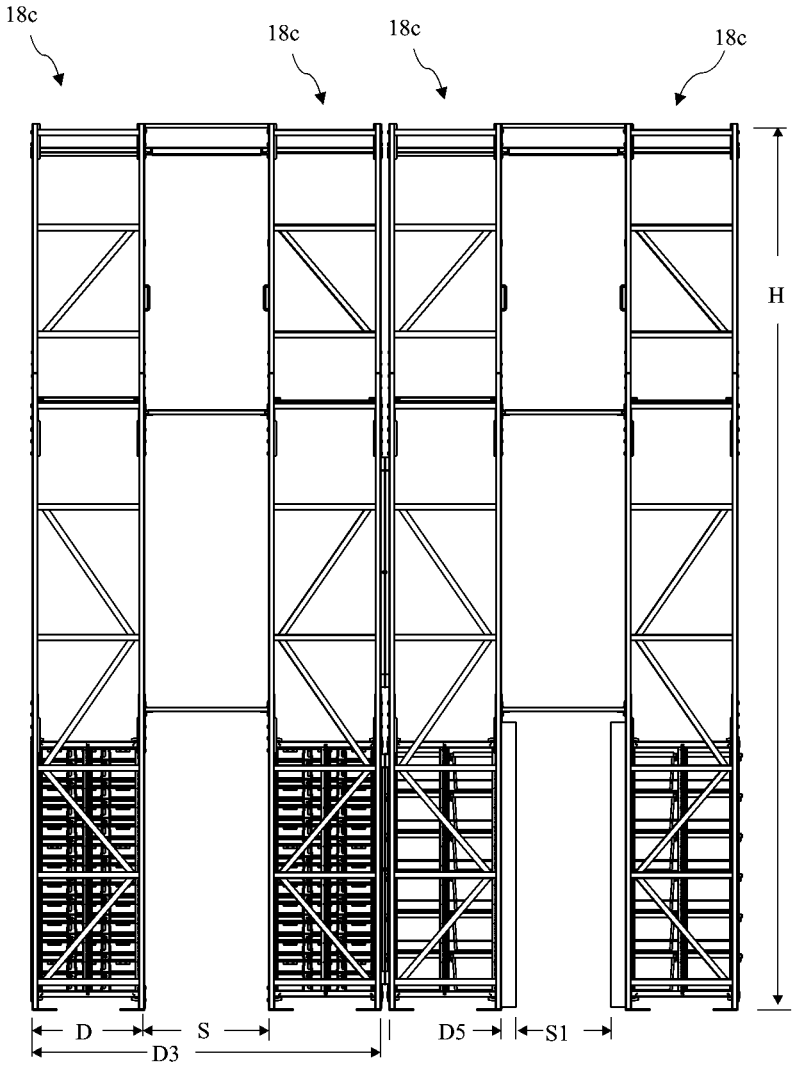
FIG. 10 shows an end view of a storage facility including adjacent rows of the convertible media and document storage system according to the present invention.

An end view of a storage facility including adjacent rows of the convertible media and document storage system 10 according to the present invention is shown in FIG. 10. Commonly, the document storage system 10 is used in very large storage areas having many rows of storage. Each section has the depth D and the sections are separated by aisles providing a separation S approximately equal to the depth D. Walkways 13 are provided to access the center and top sections.

The present invention thus includes storage units, either container storage, or open slot storage, supported by hanging from a frame or other overhead support structure. Substantially all of the weight of the storage is supported in tension from the overhead structure, and while the storage may be attached to a frame at the bottom of the storage unit, such bottom attachment is primarily for stabilizing the storage unit, and does not provide substantial or required vertical support. Such method of supporting from above the storage facilitates the convertible storage system of the present invention and because columns in tension require much less strength than column in compression, the weight and size of the storage units is minimized.

While the invention herein disclosed has been described by means of specific embodiments and applications thereof, numerous modifications and variations could be made thereto by those skilled in the art without departing from the scope of the invention set forth in the claims.

We claim:

1. A configurable storage system comprising:

at least one rectangular frame having a width dimension with width W and a depth dimension with depth D, the frame having a face along the width dimension, the frame comprising:

four horizontally spaced apart vertical uprights, one of the uprights at each corner of the frame, the uprights forming a rectangular horizontal footprint having the width W and the depth D;

at least one pair of lower horizontal beams attached to the uprights and extending in the width dimension of the frame and residing at the same height;

a pair of upper horizontal beams vertically spaced apart above each of the at least one pair of lower horizontal beams and extending in the width dimension of the frame and residing at the same height, the pair of lower horizontal beams and the pair of upper horizontal beams spaced apart vertically by a section height Hs; and end bracing connecting the uprights along the depth dimension, wherein the width W, the depth D, and the height Hs define a section of the storage system; and storage clamped to the upper horizontal beams in at least one of the sections of the storage system, the storage comprising container storage comprising:

pilasters attached to the upper horizontal beams; and pairs of opposing racks attached to the pilasters and providing ledges receiving containers, wherein the pilasters reach across the depth dimension of the frame and include top bars, and top clamping fingers attached at each end of the top bars, for tightly sandwiching a horizontal edge of the upper horizontal beams between the top bars and top clamping fingers to attach the pilasters to the upper horizontal beams.

2. The configurable storage system of claim 1, wherein the pilasters comprise pairs of left and right pilasters, the left and right pilasters laterally spaced apart along the width dimension of the frames and hung from the upper horizontal beams and cooperating to receive the containers.

3. The configurable storage system of claim 2, wherein at least one of the left and right pilasters is adjustably attached to the upper horizontal beams and the separation of the left and right pilaster is adjustable for different width containers.

4. The configurable storage system of claim 2, wherein:

the pilasters include a multiplicity of vertically spaced apart holes; and the racks are wireform racks having bent ends for engaging the holes in the pilasters to attach and vertically position the racks.

5. The configurable storage system of claim 1, wherein the horizontal edges of the upper horizontal beams are horizontal lower edges of the upper horizontal beams.

6. A configurable storage system of comprising:

at least one rectangular frame having a width dimension with width W and a depth dimension with depth D, the frame having a face along the width dimension, the frame comprising:

four horizontally spaced apart vertical uprights, one of the uprights at each corner of the frame, the uprights forming a rectangular horizontal footprint having the width W and the depth D;

at least one pair of lower horizontal beams attached to the uprights and extending in the width dimension of the frame and residing at the same height;

a pair of upper horizontal beams vertically spaced apart above each of the at least one pair of lower horizontal beams and extending in the width dimension of the frame and residing at the same height, the pair of lower horizontal beams and the pair of upper horizontal beams spaced apart vertically by a section height Hs; and end bracing connecting the uprights along the depth dimension, wherein the width W, the depth D, and the height Hs define a section of the storage system; and storage clamped to the upper horizontal beams in at least one of the sections of the storage system, wherein:

the storage is container storage comprising:

pilasters attached to the upper horizontal beams; and pairs of opposing racks attached to the pilasters and providing ledges receiving containers; and the pilasters include bottom bars reaching the length of the bottoms of the pilasters;

bottom clamping fingers are attached to bottom surfaces at each end of the bottom bars; and top horizontal edges of the lower horizontal beams are sandwiched between the bottom clamping fingers and the bottom bar to attach the pilasters to the bottom horizontal beams.

7. The configurable storage system of claim 6, wherein: the pilasters further include top bars and top clamping fingers are attached to top surfaces at each end of the top bars; bottom horizontal edges of the upper horizontal beams are sandwiched between the top clamping fingers and the top bars to further attach the pilasters to the upper horizontal beams; and the top and bottom clamping fingers provide all of the necessary attachment of the pilasters to the frames.

8. A configurable storage system comprising:

at least one rectangular frame having a width dimension with width W and a depth dimension with depth D, the frame having a face along the width dimension, the frame comprising:

four horizontally spaced apart vertical uprights, one of the uprights at each corner of the frame, the uprights forming a rectangular horizontal footprint having the width W and the depth D;

at least one pair of lower horizontal beams attached to the uprights and extending in the width dimension of the frame and residing at the same height;

a pair of upper horizontal beams vertically spaced apart above each of the at least one pair of lower horizontal beams and extending in the width dimension of the frame and residing at the same height, the pair of lower horizontal beams and the pair of upper horizontal beams spaced apart vertically by a section height Hs; and end bracing connecting the uprights along the depth dimension, wherein the width W, the depth D, and the height Hs define a section of the storage system; and storage clamped to the upper horizontal beams in at least one of the sections of the storage system, wherein the at least one frame comprises at least two rectangular frames, each having the width dimension with width W and the depth dimension with depth D, the frames residing in parallel with faces along the width dimension facing each other and spaced apart by an aisle providing spacing S between the frames which is approximately the width W; and the storage is open slot storage units comprising:

horizontal overhead rails attached to one of the pairs of upper horizontal beams and reaching across the pair of upper horizontal beams and across the aisle to an adjacent one of the frames; and drawers slidably carried by the overhead rails and slidable into the aisle for providing access to stored material; and the rails include rail top bars and rail top clamping fingers attached at each end of the rail top bars for tightly sandwiching a horizontal edge of the upper horizontal beams between the rail top bars and rail top clamping fingers to attach the rails to the upper horizontal beams.

9. The configurable storage system of claim 8, wherein:

the open slot storage units include bottom guides reaching the length of the bottom of the open slot storage units;

bottom guide clamping fingers are attached to bottom surfaces at each end of the bottom guides;

a second horizontal edge of the lower horizontal beams is sandwiched between the bottom guide clamping fingers and the bottom guide to attach the bottom guides to the bottom horizontal beams.

10. The configurable storage system of claim 9 wherein the top clamping fingers comprise:

a short straight bar pivotally cooperating with the rails proximal to a pivoting end opposite to the upper horizontal beams;

a clamping end opposite the pivoting end; and a threaded fastener engaging the rails and the clamping fingers, the threaded fasteners drawing the clamping end of the clamping fingers towards the rails to clamp the horizontal edges of the pair of upper horizontal beams between the clamping end of the clamping fingers and the rails.

11. The configurable storage system of claim 10, wherein the top and bottom clamping fingers provide all of the necessary attachment of the open slot storage units to the frames.

12. The configurable storage system of claim 1, wherein:

the at least one frame comprises at least two rectangular frames, each having the width dimension with width W and the depth dimension with depth D, the frames residing in parallel with faces along the width dimension facing each other and spaced apart by an aisle providing spacing S between the frames which is approximately the width W.

13. The configurable storage system of claim 12, wherein the storage further comprises:

open slot storage units comprising:

horizontal overhead rails attached to one of the pairs of upper horizontal beams and reaching across the pair of upper horizontal beams and across the aisle to an adjacent one of the frames; and drawers slidably carried by the overhead rails and slidable into the aisle for providing access to stored material.

14. A configurable storage system comprising:

at least two rectangular frames, each having a width dimension with width W and a depth dimension with depth D, the frames residing in parallel with faces along the width dimension facing each other and spaced apart by an aisle providing spacing S between the frames, each frame comprising:

four horizontally spaced apart vertical uprights, one of the uprights at each corner of the frame, the uprights forming a rectangular horizontal footprint having the width W and the depth D;

at least one pair of lower horizontal beams attached to the uprights and extending in the width dimension of the frame and residing at the same height;

a pair of upper horizontal beams vertically spaced apart above each of the at least one pair of lower horizontal beams and extending in the width dimension of the frame and residing at the same height, the pair of lower horizontal beams and the pair of upper horizontal beams spaced apart vertically by a section height Hs; and end bracing connecting the uprights along the depth dimension, wherein the width W, the depth D, and the height Hs define a section of the storage system; and container storage residing in at least one of the sections of the storage system and comprising:

pairs of pilasters hanging from the upper horizontal beams and laterally spaced apart in the width dimension of the frames;

pairs of opposing racks attached to the pilasters and providing ledges receiving containers;

pilaster top bars and top clamping fingers attached at each end of the top bars for tightly sandwiching a horizontal edge of the upper horizontal beams between the top bars and top clamping fingers to attach the pilasters to the upper horizontal beams;

pilaster bottom bars reaching the length of the bottoms of the pilasters;

bottom clamping fingers attached to bottom surfaces of the bottom bars at each end of the bottom bars; and a second horizontal edge of the lower horizontal beams sandwiched between the bottom clamping fingers and the bottom bar to attach the pilasters to the bottom horizontal beams.

15. The configurable storage system of claim 1, wherein the storage system further includes open slot storage interchangeably having top bars and repositionably attachable between horizontally spaced apart pairs of said upper horizontal beams by clamping the top bars of the open slot storage to the upper horizontal beams.

* * * * *